US006287219B1

(12) United States Patent
Addington

(10) Patent No.: US 6,287,219 B1
(45) Date of Patent: Sep. 11, 2001

(54) GOLFER'S TOOL

(76) Inventor: Michael D. Addington, 130 N. Meridian St., Winchester, IN (US) 47394

( * ) Notice: Subject to any disclaimer, the term of this patent is extended or adjusted under 35 U.S.C. 154(b) by 0 days.

(21) Appl. No.: 09/483,503

(22) Filed: Jan. 14, 2000

(51) Int. Cl.[7] ..... A63B 57/00
(52) U.S. Cl. ..... 473/386
(58) Field of Search ..... 473/386, 408, 473/132, 284, 286

(56) References Cited

U.S. PATENT DOCUMENTS

| | | | |
|---|---|---|---|
| 3,203,799 | | 8/1965 | Antonious . |
| 3,206,197 | | 9/1965 | Miotke . |
| 3,540,727 | | 11/1970 | Hoe . |
| 3,697,082 | | 10/1972 | Di Laura et al. . |
| 3,981,509 | | 9/1976 | Myer . |
| 4,063,731 | | 12/1977 | Kitay . |
| 4,086,678 | | 5/1978 | Torr . |
| 4,239,216 | | 12/1980 | Bauer . |
| 4,260,157 | | 4/1981 | Jones et al. . |
| 4,262,562 | | 4/1981 | MacNeill . |
| 4,336,940 | | 6/1982 | Sprague . |
| 4,516,773 | | 5/1985 | Martin . |
| 4,862,970 | | 9/1989 | Hlavacek . |
| 4,886,196 | | 12/1989 | Plummer . |
| 4,891,748 | | 1/1990 | Mann . |
| 4,895,372 | | 1/1990 | Muller . |
| 4,951,945 | | 8/1990 | Gamble . |
| 4,951,947 | | 8/1990 | Kopfle . |
| 4,960,239 | | 10/1990 | Wait . |
| 4,984,790 | | 1/1991 | Dowdy et al. . |
| 4,989,868 | | 2/1991 | Manko . |
| 4,995,614 | | 2/1991 | Tange . |
| 5,085,431 | | 2/1992 | McGuire . |
| 5,131,661 | | 7/1992 | Jorgensen . |
| 5,152,524 | | 10/1992 | Brown . |
| 5,184,295 | | 2/1993 | Mann . |
| 5,209,738 | | 5/1993 | Bruno . |
| 5,211,395 | | 5/1993 | Liao . |
| 5,226,647 | | 7/1993 | Notarmuzi . |
| 5,242,161 | | 9/1993 | Wilkirson . |
| 5,310,177 | | 5/1994 | Conrad et al. . |
| 5,407,194 | | 4/1995 | Snow . |
| 5,409,212 | | 4/1995 | Arnett . |
| 5,413,348 | | 5/1995 | Basso . |
| 5,439,213 | * | 8/1995 | Pimentel ..... 473/386 |
| 5,540,432 | * | 7/1996 | Keller ..... 473/386 |
| 5,928,091 | * | 7/1999 | Corriveau ..... 473/386 |

* cited by examiner

*Primary Examiner*—Steven Wong
(74) *Attorney, Agent, or Firm*—Woodard, Emhardt, Naughton, Moriarty & McNett

(57) ABSTRACT

A golfer's tool is provided. It has a divot repair tool, such as a fork having a pair of prongs. It also has a golf tee head engagement member for engaging the head of a golf tee. This engagement member may be used to apply axially a downward force to insert the tee into the ground. The engagement member preferably is a distance from the surface of the device which contacts the ground to provide indexing of the height of the golf tee above the ground.

16 Claims, 2 Drawing Sheets

GOLFER'S TOOL

BACKGROUND OF THE INVENTION

The present invention relates to a tool for golfers, and more specifically relates to a tool providing for divot repair and providing for height indexing insertion of a golf tee.

A wide variety of golfing tools have been developed. These include divot repair forks and the like. The present invention is advantageous in that it provides a divot repair tool while also providing a device for insertion of the golf tee. The device for insertion of a golf tee allows for systematic and consistent insertion of a golf tee to a consistent height, thereby facilitating the consistency of a player's golf game. It further facilitates insertion of a golf tee by affording additional surface area which may be helpful in inserting the golf tee into hard soil.

SUMMARY OF THE INVENTION

The invention is set forth in the claims, the following merely identifying several features which may or may not be included in the invention. The invention comprises a golfer's tool. It may include a divot repair tool, such as a fork having a pair of prongs. It also may include a golf tee head engagement member for engaging the head of a golf tee. This engagement member may be used to apply an axially downward force to insert the tee into the ground. The engagement member preferably is a distance from the surface of the device which contacts the ground to provide indexing of the height of the golf tee above the ground. The invention may include a yoke for receiving the half of the golf tee in a position beneath the golf tee head engagement member.

One object of the present invention is to provide an improved golfer's tool. This and other objects are set forth in the following specification and drawings.

DESCRIPTION OF THE PREFERRED EMBODIMENTS

Figure 1A:
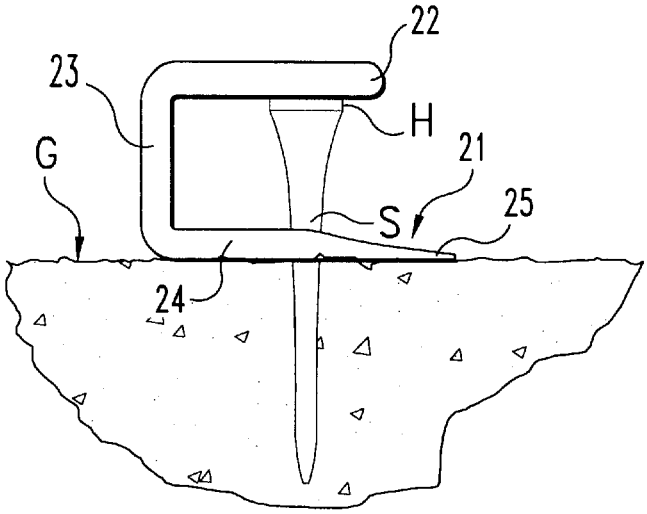
FIG. 1A is a right side elevation view of one embodiment of the present invention with a golf tee therein.

For the purposes of promoting an understanding of the principles of the invention, reference will now be made to the embodiment illustrated in the drawings and specific language will be used to describe the same. It will nevertheless be understood that no limitation of the scope of the invention is thereby intended, and alterations and modifications in the illustrated device and method, and further applications of the principles of the invention as illustrated therein are herein contemplated as would normally occur to one skilled in the art to which the invention relates.

Referring to the drawing FIGS. 1A–6, one version of the golfer's tool 20 is shown. The golfer's tool includes a divot repair tool 21 which, in its preferred version, is a two-prong fork. As illustrated, the fork has a right prong 25 and a left prong 26. These prongs are used to repair divots in the golf course by the golfer.

Figure 1B:
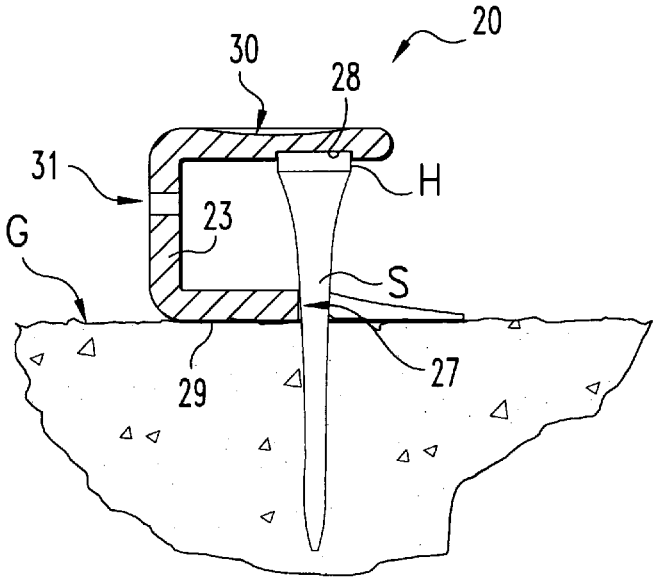
FIG. 1B is the device of FIG. 1A shown in section with a golf tee therein.
Figure 2:
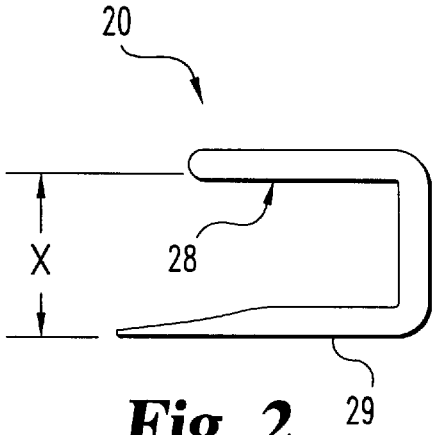
FIG. 2 is a left side elevation view of the device of FIG. 1A in isolation.

Although not essential, it is preferred that the golfer's tool form a generally C-shaped element when viewed from the side as shown in FIGS. 1A and 1B. The C-shaped nature of the device consists of an upper tail 22 and a lower tail 24 connected by middle region 23. These of course may be of varying proportion and shape, rectilinear or rounded or otherwise so as to provide a general C-shape in the preferred version. Moreover, preferably the upper tail 22, middle region 23 and lower tail 24, including the prongs of this fork as shown, all made from a unitary piece of material. Preferably, this will be cast metal although may be bent metal or molded plastic. Cast metal is thought to form the smoothest and most appealing material selection. Also as can be seen from the cross-sectional view 1B, the thickness of the C-shaped body is preferably significantly less than its width (see FIGS. 3–6). As such, it is possible to fabricate the C-shaped body by bending material such as metal to form the C-shaped arrangement. In one version the device is about 1 inch tall, ¾ inch wide, and 1⅝ inch in total length of section 24 and 1¼ inch lengths of section 22.

Preferably, the pair of prongs form a yoke 27 therebetween. Ideally, the yoke has a rounded inner surface which is equal to or greater than the corresponding curvature of shaft S of a golf tee. In this way, the golf tee shaft S rests in the yoke firmly supported without hanging up on the yoke.

Figure 3:
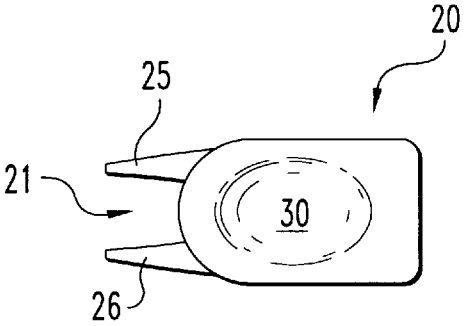
FIG. 3 is a top plan view of the device of FIG. 2.
Figure 4:
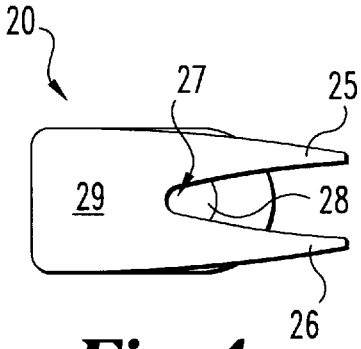
FIG. 4 is a bottom plan view of the device of FIG. 2.
Figure 5:
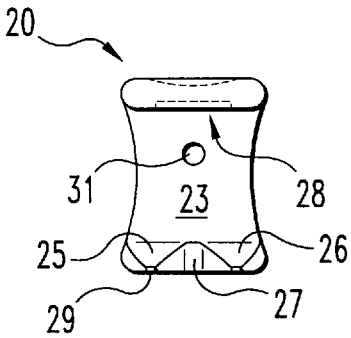
FIG. 5 is a front elevation view of the device of FIG. 2.
Figure 6:
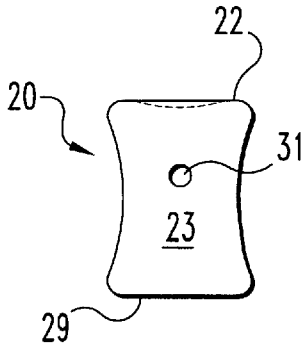
FIG. 6 is a rear elevation view of the device of FIG. 2.

The head H of the golf tee engages a surface on the device which allows axially downward force to be applied to the tee to insert it into the ground. This engagement structure may be a recess 28 as shown on the bottom side of upper tail section 22. This recess receives the head therein and restricts a lateral movement of the head during insertion of the tee. It is to be noted that other engagement structures may be used, such as a male protrusion which protrudes into the concave recess along the top side of the tee, one or more protrusions around the outside of the head of the tee, a rib around the head, a friction surface, or simply a flat surface on the underside of upper tail 22. As can be seen in FIG. 3, a recess 30 optionally is provided on top to ergonomically receive a thumb or finger of the user. In any event, the top surface of the device 20 above the tee head engagement is preferably greater in surface area than the actual head of the tee, thereby facilitating a more comfortable application of force to the top of the device to be transmitted to the head of the tee. This makes it easier to drive the tee into hard soil. Yoke 27 preferably is smaller than the diameter of the head. In this way, the tool also may be used in a claw hammer mode to withdraw a tee from the soil. Optionally, one or more other notches may be provided in the tool for extraction of the tee. Also, hole 31 may be optionally provided to facilitate hanging by a key chain or a lanyard to a player's golf bag or otherwise.

Preferably, the height of the head tee engagement 28 from surface 29 is height X. Preferably, height X is less than the axial length and provides an indexing length for the tee height above the surface of the ground G upon insertion, as illustrated in FIGS. 1A and 1B. Height X may be a variety of distances based on user preference, it having been found that lengths of about one and a quarter inches (31.8 millimeters), one inches (25.4 millimeters) and three quarter inches (19.1 millimeters) are suitable for most golfers. With the use of height X as an indexing mechanism, the user may insert the golf tee with surface 29 along the bottom surface of lower tail 24 in contact with the ground surface G. In this way, consistency is aided in the player's tee shot by having the tee consistently inserted to the same height with respect to the ground. The present device may be sold in sets of various lengths as set forth above or otherwise to allow the user to select an appropriate length to their liking. Also, an alternative embodiment of the device may be made collapsible so that it more conveniently fits in the user's pocket and/or so height X is adjustable. Such collapsibility may include the use of one or more hinged elements or telescoping elements. Also, the present invention may be configured as a generally flat instrument with the orientation of the tee in insertion mode being co-planer with the prongs of the divot tool. Preferably, although not necessarily, the prongs 25 and 26 protrude out beyond the front edge of proportion 22.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A golfer's tool, comprising:

a divot repair fork including a pair of prongs;

a golf tee head engagement member for applying axially downward force to a golf tee to insert the tee into the ground, said golf tee head engagement member being connected to said divot repair fork, the tool further comprising a surface for contacting the ground upon the inserting of the tee into the ground, said surface being positioned a distance from said golf tee head engagement member which is less than the length of the golf tee to provide indexing of the height the golf tee head extends above the ground, wherein said divot repair fork and said golf tee head engagement member are formed from a unitary piece of material.

2. The tool of claim 1 wherein said prongs form a yoke therebetween, said yoke being vertically positioned directly beneath said golf tee head engagement member and sized to receive a shaft of the golf tee in said yoke.

3. The tool of claim 2 wherein said surface for contacting the ground is along a bottom side of said divot repair fork.

4. The tool of claim 3 wherein said surface for contacting the ground and said golf tee head engagement member are spaced apart a distance equal to or less than about one and one quarter inch.

5. The tool of claim 4 wherein said surface for contacting the ground and said golf tee head engagement member are spaced apart a distance equal to or less than about three quarters of an inch.

6. The tool of claim 4 wherein said golf tee head engagement member and said divot repair fork are each part of a C-shaped body, said divot repair fork forming a lower tail of said C-shaped body and said golf tee head engaging member being formed on an underside of an upper tail of said C-shaped member.

7. The tool of claim 6 wherein said golf tee head engagement member includes a recessed portion for receiving the golf tee head therein.

8. The tool of claim 1 wherein said surface for contacting the ground is along a bottom side of said divot repair fork.

9. The tool of claim 1 wherein said surface for contacting the ground and said golf tee head engagement member are spaced apart a distance equal to or less than about one and one quarter inch.

10. The tool of claim 1 wherein said surface for contacting the ground and said golf tee head engagement member are spaced apart a distance equal to or less than about three quarters of an inch.

11. The tool of claim 1 wherein said golf tee head engagement member and said divot repair fork are each part of a C-shaped body, said divot repair fork forming a lower tail of said C-shaped body and said golf tee head engaging member being formed on an underside of an upper tail of said C-shaped member.

12. The tool of claim 1 wherein said golf tee head engagement member includes a recessed portion for receiving the golf tee head therein.

13. A golfer's tool, comprising:

a divot repair tool;

a golf tee head engagement member for applying axially downward force to a golf tee to insert the tee into the ground, said golf tee head engagement member being connected to said divot repair tool, the tool further comprising a surface for contacting the ground upon the inserting of the tee into the ground, said surface being positioned a distance from said golf tee head engagement member which is less than the length of the golf tee to provide indexing of the height the golf tee head extends above the ground, wherein said golf tee head engagement member and said divot repair tool are each part of a C-shaped body, wherein said divot repair fork and said golf tee head engagement member are formed from a unitary piece of material, said divot repair tool forming a lower tail of said C-shaped body and said golf tee head engaging member being formed on an underside of an upper tail of said C-shaped member.

14. The tool of claim 13 wherein said surface for contacting the ground and said golf tee head engagement member are spaced apart a distance equal to or less than about one and one quarter inch.

15. The tool of claim 13 wherein said golf tee head engagement member includes a recessed portion for receiving the golf tee head therein.

16. The tool of claim 13 wherein said divot repair tool includes yoke vertically positioned directly beneath said golf tee head engagement member and sized to receive a shaft of the golf tee in said yoke.

* * * * *